US007645501B2

(12) United States Patent
Sawyer et al.

(10) Patent No.: US 7,645,501 B2
(45) Date of Patent: Jan. 12, 2010

(54) MULTI-LAYERED SPORTS PLAYING FIELD WITH A WATER DRAINING, PADDING LAYER

(75) Inventors: Daniel C. Sawyer, Boulder, CO (US); Lewis A. Bowman, Chester Springs, PA (US); Renald W Colonna, Butler, PA (US); Corey D Comperatore, Sarver, PA (US)

(73) Assignee: Brock USA, LLC, Boulder, CO (US)

( * ) Notice: Subject to any disclaimer, the term of this patent is extended or adjusted under 35 U.S.C. 154(b) by 72 days.

(21) Appl. No.: 11/879,486

(22) Filed: Jul. 17, 2007

(65) Prior Publication Data

US 2008/0075896 A1 Mar. 27, 2008

Related U.S. Application Data

(63) Continuation of application No. 10/645,719, filed on Aug. 20, 2003, now Pat. No. 7,244,477.

(51) Int. Cl.
*B32B 9/00* (2006.01)

(52) U.S. Cl. ..... 428/95; 428/17

(58) Field of Classification Search ..... 428/95, 428/17

See application file for complete search history.

(56) References Cited

U.S. PATENT DOCUMENTS 3,438,312 A 4/1969 Becker et al.

5,514,722 A 5/1996 Di Geronimo

FOREIGN PATENT DOCUMENTS

| | | | |
|---|---|---|---|
| CH | 671787 | | 7/1986 |
| WO | 99/28557 | | 6/1999 |
| WO | WO 02/075053 | * | 9/2002 |
| WO | 03/000994 | | 1/2003 |

* cited by examiner

*Primary Examiner*—David R Sample
*Assistant Examiner*—Daniel Miller
(74) *Attorney, Agent, or Firm*—MacMillan, Sobanski and Todd, LLC

(57) ABSTRACT

A multi-layered sports playing field including a top layer made of substantially artificial material simulating a natural playing surface such as grass and a padding layer positioned between the top layer and the base or dirt layer. The padding layer is made of a plurality of discrete beads of substantially elastic, resilient material (e.g., foam) with portions of adjacent beads abutting one another and other portions being spaced from each other. Substantially all of the adjacent beads are preferably integrally joined (e.g., glued, fused) together at their abutting portions. The padding layer is very porous and breathable and preferably includes feet members supporting the main body of the padding layer above the base or dirt layer to create a water channel of interconnected portions to enhance water drainage to the sides of the field.

18 Claims, 9 Drawing Sheets

MULTI-LAYERED SPORTS PLAYING FIELD WITH A WATER DRAINING, PADDING LAYER

RELATED APPLICATIONS

This application is a Continuation of U.S. patent application Ser. No. 10/645,719, filed Aug. 20, 2003, and issued Jul. 17, 2007, as U.S. Pat. No. 7,244,477 and entitled MULTI-LAYERED SPORTS PLAYING FIELD WITH A WATER DRAINING, PADDING LAYER, all of which is incorporated in the present application in its entirety.

BACKGROUND OF THE INVENTION

1. Field of the Invention

This invention relates to the field of sports playing fields and more particularly to artificial playing fields.

2. Discussion of the Background

Modern playing fields for football, baseball, soccer, and other sports are typically multi-layered composites of natural and/or artificial materials. In designing such composites, two primary but often competing concerns are the athlete's safety and the hardness of the field. In most sports, a relatively hard field is desired for speed. However, a relatively soft field is equally desirable to protect the athletes from injuries due to contact with the field itself from tackling, jumping, falls, and the like.

Hard, fast fields commonly may have a relatively high and potentially harmful impact rating that can lead to injuries. Impact rating systems for fields vary widely and are determined in any number of different ways (e.g., dropping a weight on a portion of the field). Nevertheless, in each case, the rating is intended to relate to measuring the equivalent of, for example, a football player landing on his helmet during a game or being violently thrown to the field. A hard, fast field may well have an impact rating of 140-150 times gravity (140-150 g's). Softer fields may have a safer rating more on the order of 60-80 g's but such fields typically play too slow for many athletes, particularly higher level and professional ones.

In addition to the concerns of safety and hardness, other factors are involved in designing a field. In nearly all current sports fields, water drainage is very important as the field must be able to quickly and efficiently drain away water. However, combining the design issues of safety and hardness with water management often leads to conflicting results. As for example, a new field that begins as a relatively soft one may have sublayers of pea gravel or sand for drainage. The sublayers then tend to compact over time and can change the initially soft field into a harder one. Although an excellent drainage material, gravel and sands thus have their drawbacks.

Sports fields further need to present as uniform a playing surface as possible over the entire field. As indicated above, fields with sublayers of pea gravel can harden over time and change the field characteristics. Equally of concern is that they tend to do so in specific areas of the field (e.g., down the middle) destroying the uniformity of the overall playing surface. Attempts at replacing gravel sublayers for drainage have been tried but for the most part simply present their own new sets of problems.

Modular systems of artificial materials in particular have presented problems of irregularities between the pieces at the seams. Nevertheless, such modular systems of artificial materials have commercial appeal as they are much easier and faster to install than gravel and sand systems and are normally not as deep (e.g., one to three inches versus six to ten inches or more for fields with multiple layers of pea gravel). With football and soccer fields which are on the order of 80,000 square feet, gravel and sand systems can present significant consistency, time, and cost problems. Such problems can include sourcing a consistent quality of the materials in different parts of the country as well as simply hauling and handling the materials and uniformly spreading and compacting them in place.

In this light, the present invention was developed. With it, a multi-layered playing field composite is provided that is lightweight and modular. Additionally, the resulting field plays like a hard, fast one yet with the impact ratings of a relatively soft field. Further, the resulting field has excellent water drainage management and can be installed relatively quickly and easily.

SUMMARY OF THE INVENTION

This invention involves a multi-layered sports playing field including a top layer made of substantially artificial material simulating a natural playing surface such as grass. Beneath the top layer is a padding layer positionable between the top layer and the base or dirt layer. The padding layer is made of a plurality of discrete beads of substantially elastic, resilient material (e.g., foam) with portions of adjacent beads abutting one another and other portions being spaced from each other. Substantially all of the adjacent beads are preferably integrally joined (e.g., glued, fused) together at their abutting portions.

The padding layer is very porous and breathable to allow liquids and air to pass freely through it. Consequently and in addition to being elastic and resilient, the padding layer offers excellent water drainage. In the preferred embodiments, the padding layer has a main body of beads with spaced-apart feet portions or members extending downwardly from it. The feet members support the main body of the padding layer above the base or dirt layer. The spaced-apart feet members also create interconnected water channel portions between them wherein water passing through the top layer of the field and through the porous padding layer will flow laterally out to the sides of the field. The porosity of the main body of the padding layer also permits water collecting above the level of the feet members to flow laterally away through it for enhanced drainage. The padding layer is preferably modular with interlocking pieces which are designed to maintain the uniform distribution of the feet members and the overall uniformity and seamless nature of the playing field.

DETAILED DESCRIPTION OF THE INVENTION

Figure 1:
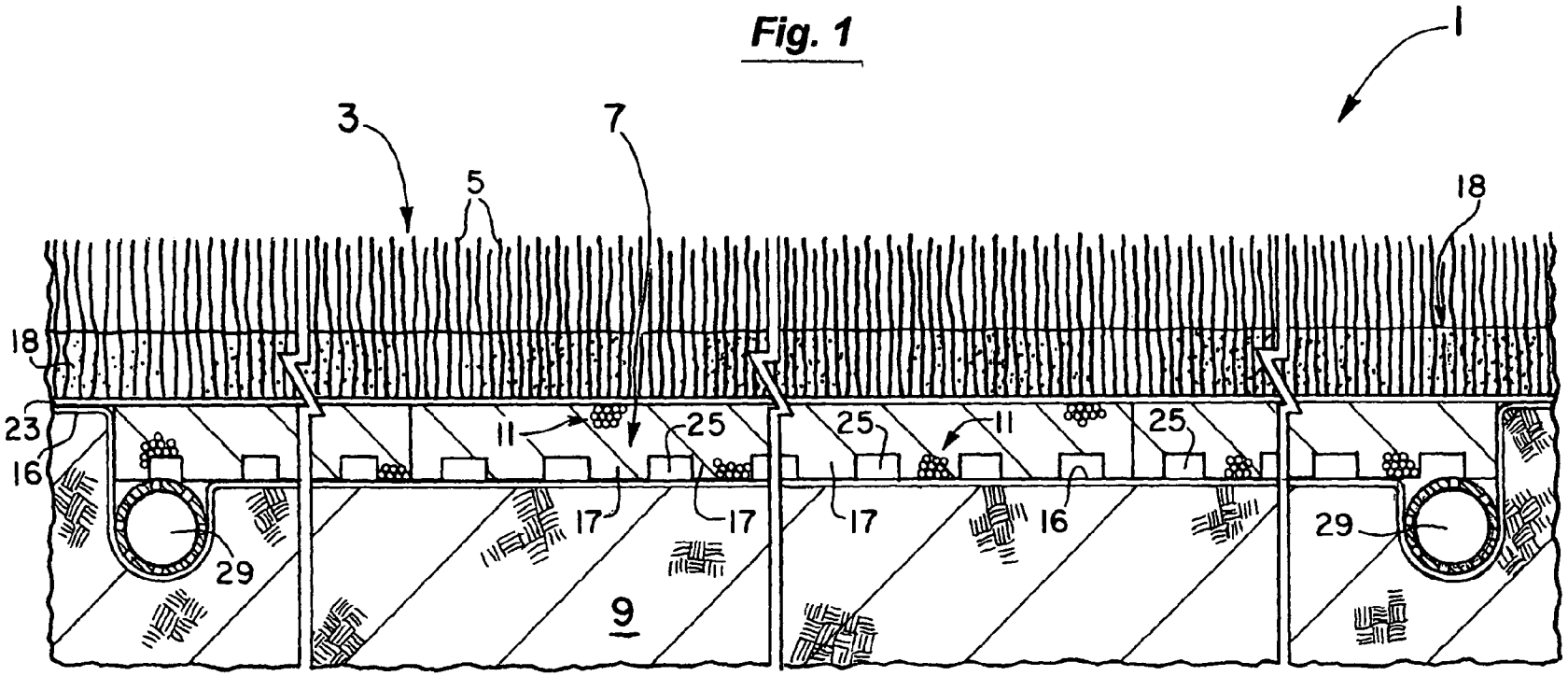
FIG. 1 is a cross-sectional view of the multi-layered sports playing field of the present invention.

As shown in FIG. 1, the multi-layered sports playing field 1 of this embodiment of the present invention includes a top layer 3 made of material simulating a natural playing surface such as grass 5. Beneath the top layer 3 is a padding layer 7 positionable as shown between the top layer 3 and the base or earth layer 9.

Figure 2:
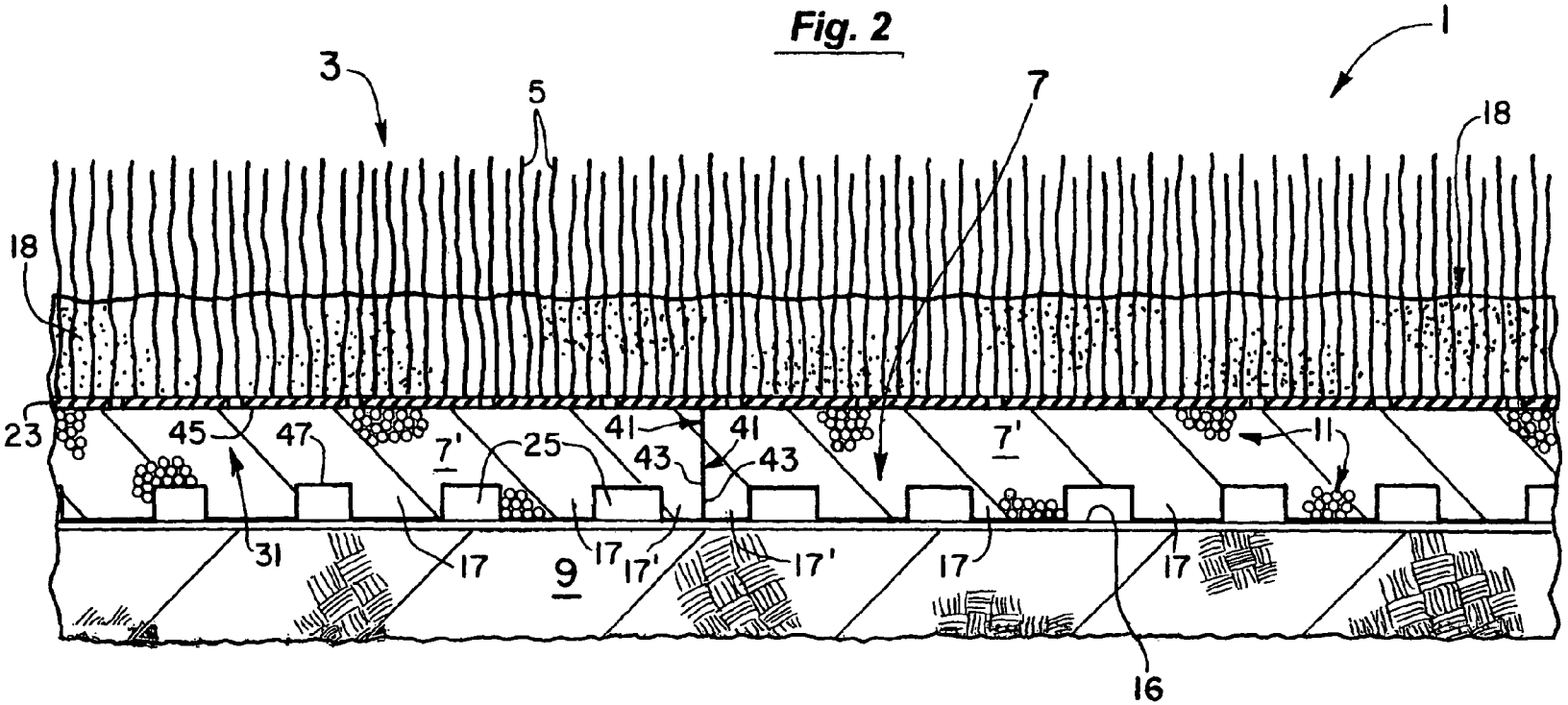
FIG. 2 is an enlarged view of FIG. 1 showing further details of the invention.

The padding layer 7 is made of a plurality of discrete beads 11 of substantially elastic, resilient material that can be deformed wherein the beads 11 will rebound to their original shapes of FIG. 1. For clarity, only groups of beads 11 are shown in the padding layer 7 of FIG. 1 but these beads 11 are distributed substantially uniformly throughout the entire padding layer 7 as will be explained in more detail below. The elastic, resilient beads 11 are preferably made of materials such as polyethylene or polypropylene. This is in contrast to materials such as polystyrene that are essentially incompressible in normal use and crush under excessive loads. In the embodiment of FIGS. 1 and 2, the beads 11 have substantially spherical shapes (see the enlarged view of FIG. 2*a*) wherein portions of adjacent beads 11 abut one another and other portions are spaced from each other. Additionally, substantially all of the adjacent beads 11 are preferably integrally joined (e.g., glued, fused) together at the abutting portions thereof.

Figure 2A:
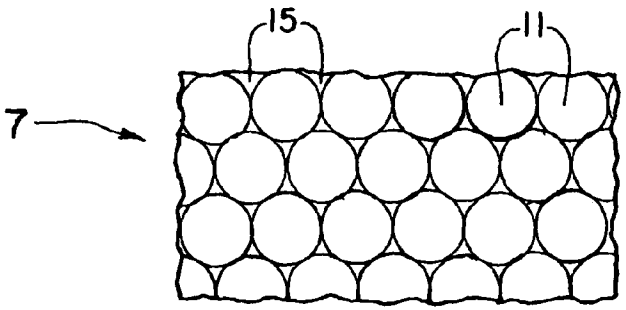
FIG. 2*a* is a view showing the beads of the padding layer of FIG. 2 wherein portion of the beads abut one another and other portions are spaced from each other.

The padding layer 7 is preferably more than one bead diameter thick so as to have multiple levels of beads 11 (see FIGS. 2 and 2*a*). The beads 11 of each level then abut one another and are integrally joined to thereby integrally join the various levels together. The diameters of the beads 11 can vary as desired (e.g., 1/12 to 1/8 inch or more) but preferably are substantially the same (e.g., 1/8 inch). The beads 11 are preferably made of closed cell foam (e.g., polyethylene, or polypropylene) and are waterproof (i.e., non-absorbent). The interstitial spaces 15 (see FIG. 2*a*) between the adjacent beads 11 are in fluid communication with each other and are substantially uniformly spaced or distributed throughout the padding layer 7. Beneath the padding layer 7 as shown in FIGS. 1 and 2, a moisture-proof film layer 16 (as for example made of 0.010 to 0.030 inches of polyvinylchloride (PVC), polyethylene, polypropylene) is preferably provided and positioned between the feet portions or members 17 of the padding layer 7 and the dirt or base layer 9. In some applications, this waterproof film layer can be eliminated or substituted with a porous, non-woven fabric layer (e.g., polyethylene, polyester, polypropylene) depending upon the particular soil conditions (e.g., the drainage properties of the dirt or earth layer 9).

Figure 3:
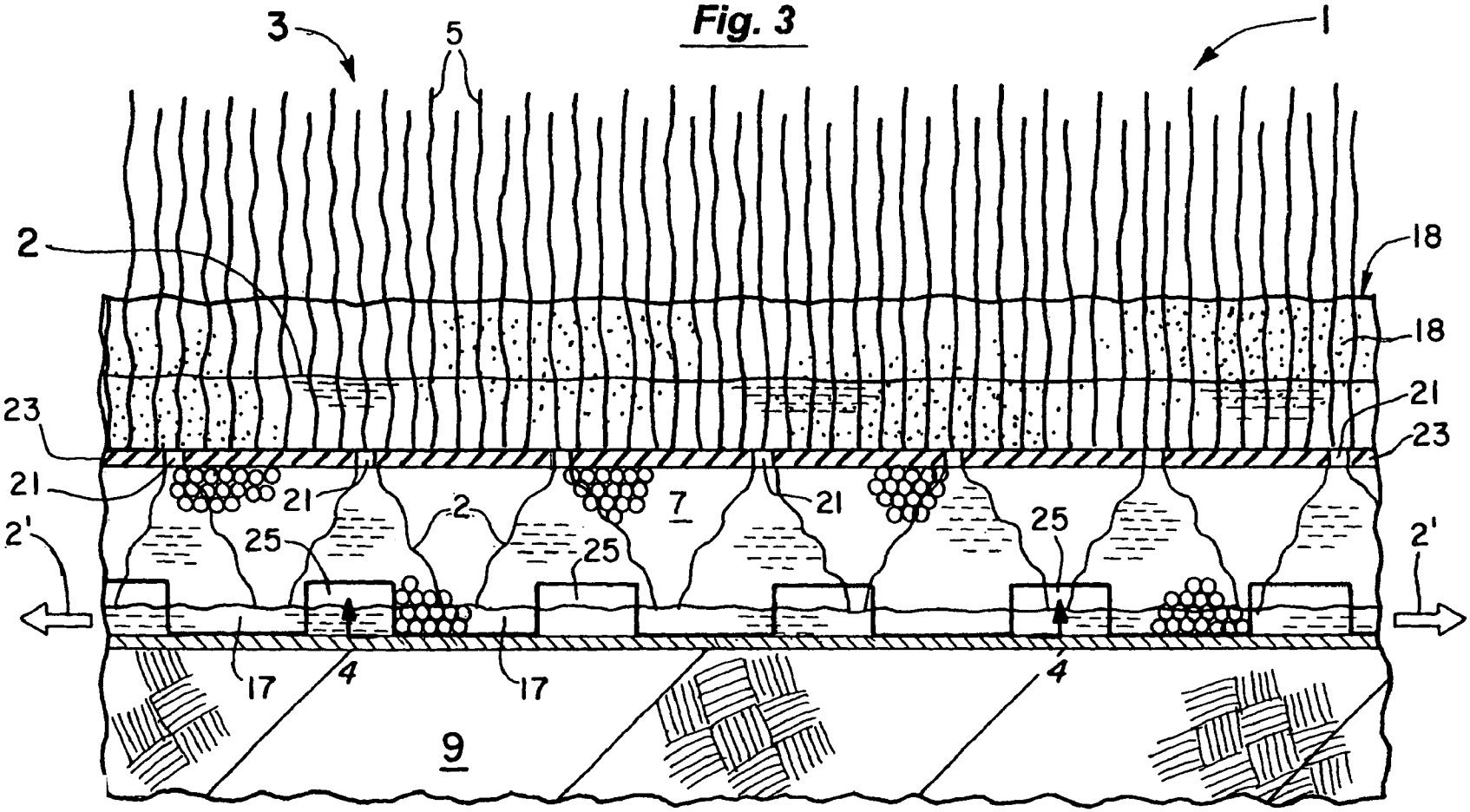
FIG. 3 is cross-sectional view similar to FIG. 2 illustrating the enhanced water drainage operation of the porous and breathable padding layer.
Figure 4:
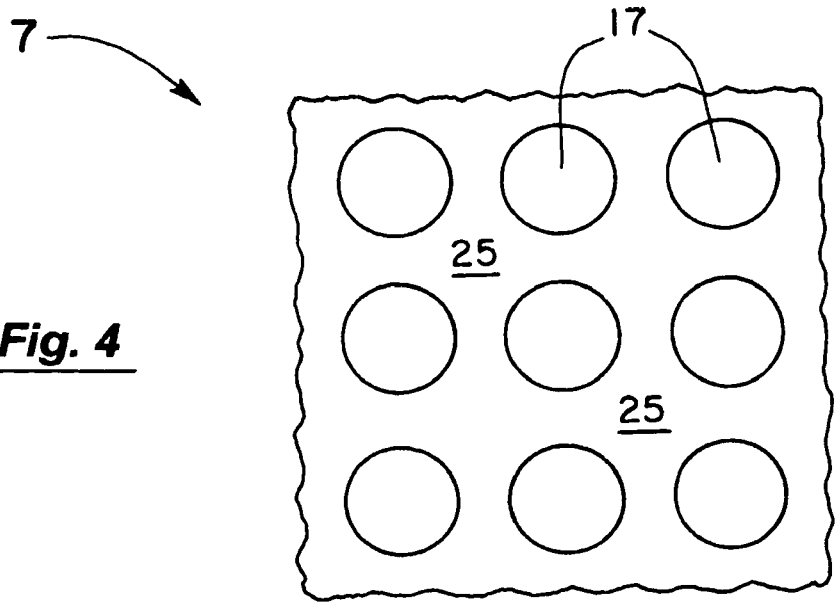
FIG. 4 is a view taken along line 4-4 of FIG. 3 showing the spacing of the feet members of the padding layer to create an interconnected water channel to drain water laterally toward the sides of the playing field.

The padding layer 7 of FIG. 2 (including the feet portions or members 17) is very porous and breathable to allow liquids and air to pass freely through the padding layer 7. In addition to being elastic and resilient, the padding layer 7 offers excellent water drainage. In use as illustrated in FIG. 3, water 2 falling on or accumulating in the top layer 3 of artificial grass 5 and particles 18 (e.g., rubber, sand) will flow through the holes 21 in the rubber mat 23 (to which the individual grass blades 5 are attached) into the padding layer 7. The padding layer 7 as indicated above is extremely porous wherein the water 2 entering the padding layer 7 through the mat holes 21 quickly passes through the paddling layer 7 into the water channel portions 25 between the feet members 17 of the padding layer 7. The feet members 17 in this regard are spaced from one another (see FIG. 4 which is a view taken along line 4-4 of FIG. 3) creating the water channel of interconnected portions 25.

Figure 5:
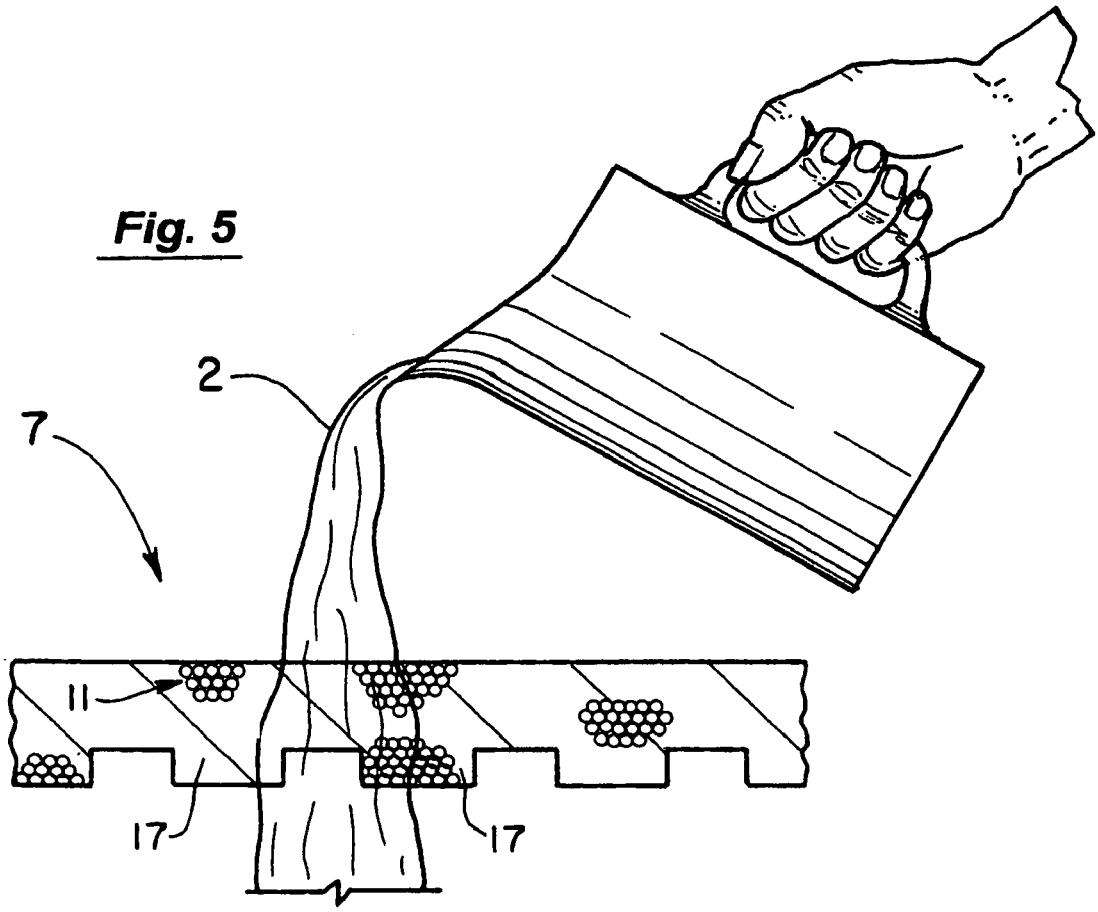
FIG. 5 illustrates the porosity of the padding layer itself which essentially will pass water freely thorough it due to the interstitial spaces between the beads of the padding layer.

The porosity of the paddling layer 7 is such that water flows almost without restriction through the padding layer 7 (including the feet members 17) via the interstitial spaces 15 between adjacent beads 11 (see again FIG. 2*a*). The padding layer 7 itself as shown in FIG. 5 can pass on the order of 300 inches of water per hour. In the multi-layered field 1 of FIGS. 1-3, the drainage rate for the overall field 1 is not restricted by the padding layer 7 but more by the rate at which the water 2' in FIG. 3 can flow laterally thorough the water channel of portions 25 and out through the perforated pipes 29 on the sides of the field 1 (see FIG. 1). Even with such restrictions, the overall drainage rate in a field such as 1 may still be on the order of 20-30 inches or more per hour. Most base or dirt layers 9 in this regard are crowned or inclined downwardly from their centers which can greatly affect the drainage rate of the field 1. However, in any event, the padding layer 7 of the preferred embodiments in virtually all field designs is not the limiting factor in such water drainage management.

Figure 6:
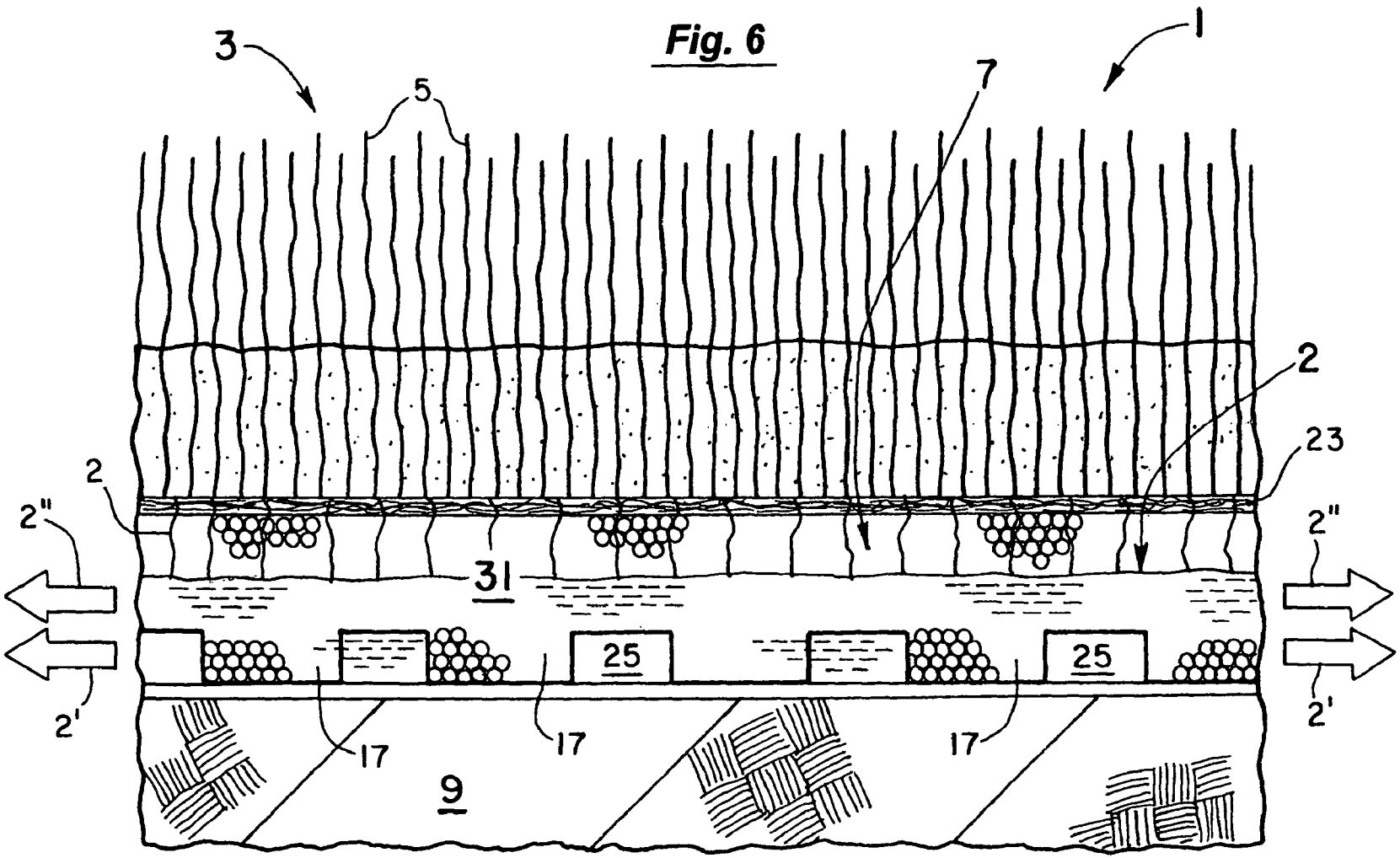
FIG. 6 is a view similar to FIG. 3 showing the ability of the padding layer to handle water that may accumulate above the feet members of the padding layer and into the main body of the padding layer.

Further, in some field designs such as in FIG. 6 in which the mat 23 for the grass 5 is more porous or even a weave, water 2 may pass so quickly through the mat 23 into the padding layer 7 as to rise to a level above the feet members 17 and water channel portions 25 up into the main body 31 of the padding layer 7. In such an event as illustrated in FIG. 6, the porosity of the padding layer 7 (which porosity is essentially omni-directional) permits the additional water as indicated by arrows 2" in FIG. 6 to flow laterally through the main body 31 itself toward the sides of the field 1. Again, and in all field designs, the padding layer 7 is preferably not the component limiting in any way the overall drainage rate of the field 1. Further, because the padding layer 7 is breathable due to the interstitial spaces 15 between the beads being in fluid communication with each other, the padding layer 7 will aid in drying out the field 1 once the water flow has diminished or ended. In this regard, the air volume and air flowing through the spaces 15 will assist in evaporating or dissipating any residual water or moisture. Further, the porous and breathable padding layer 7 can offer the additional benefit of evaporative cooling of the field 1 on hot days, as heat buildup is a significant problem of artificial turf fields when compared to natural grass.

Because adjacent beads 11 in the padding layer 7 are integrally joined together (e.g., glued, fused), the beads 11 act together to absorb forces. Consequently, impacts applied to or concentrated on particular beads 11 or areas of beads 11 under the top layer 3 are dissipated or spread out by the interaction of the integrally joined beads 11. In some cases, the vertically aligned beads that are directly compressed under the force will apply pressure outwardly and compress laterally adjacent beads not directly under the force. In other cases, adjacent and integrally joined beads will be drawn toward the compressed beads. In the preferred embodiments and with adjacent beads 11 being so joined, the beads 11 will not separate in use and the top layer 3 will not bottom out (e.g., abut against the base layer 9) when forces are applied to it.

Figure 7:
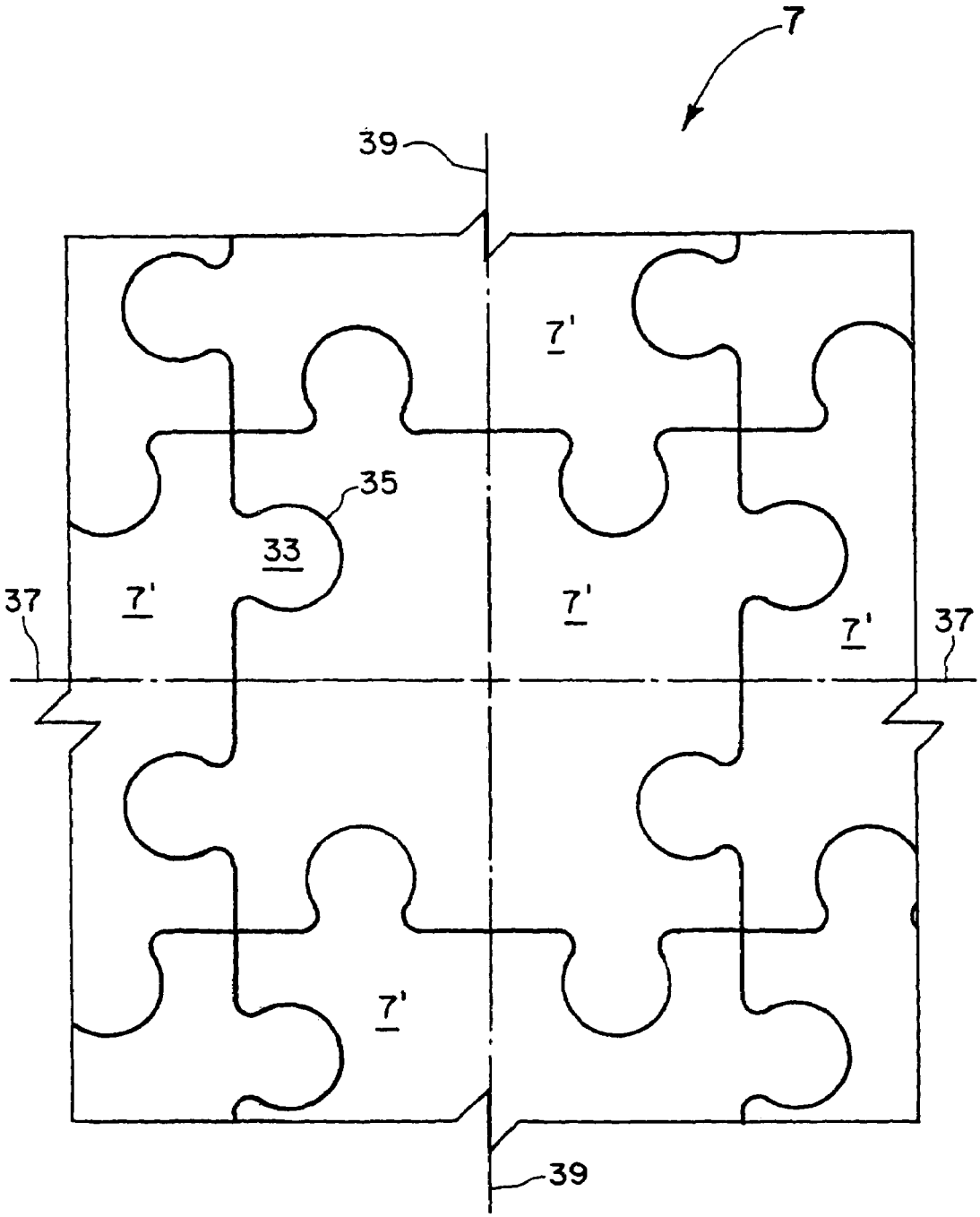
FIG. 7 is a top plan view of the modular padding layer showing the manner in which the modular pieces of the padding layer can be interlocked together.
Figure 8:
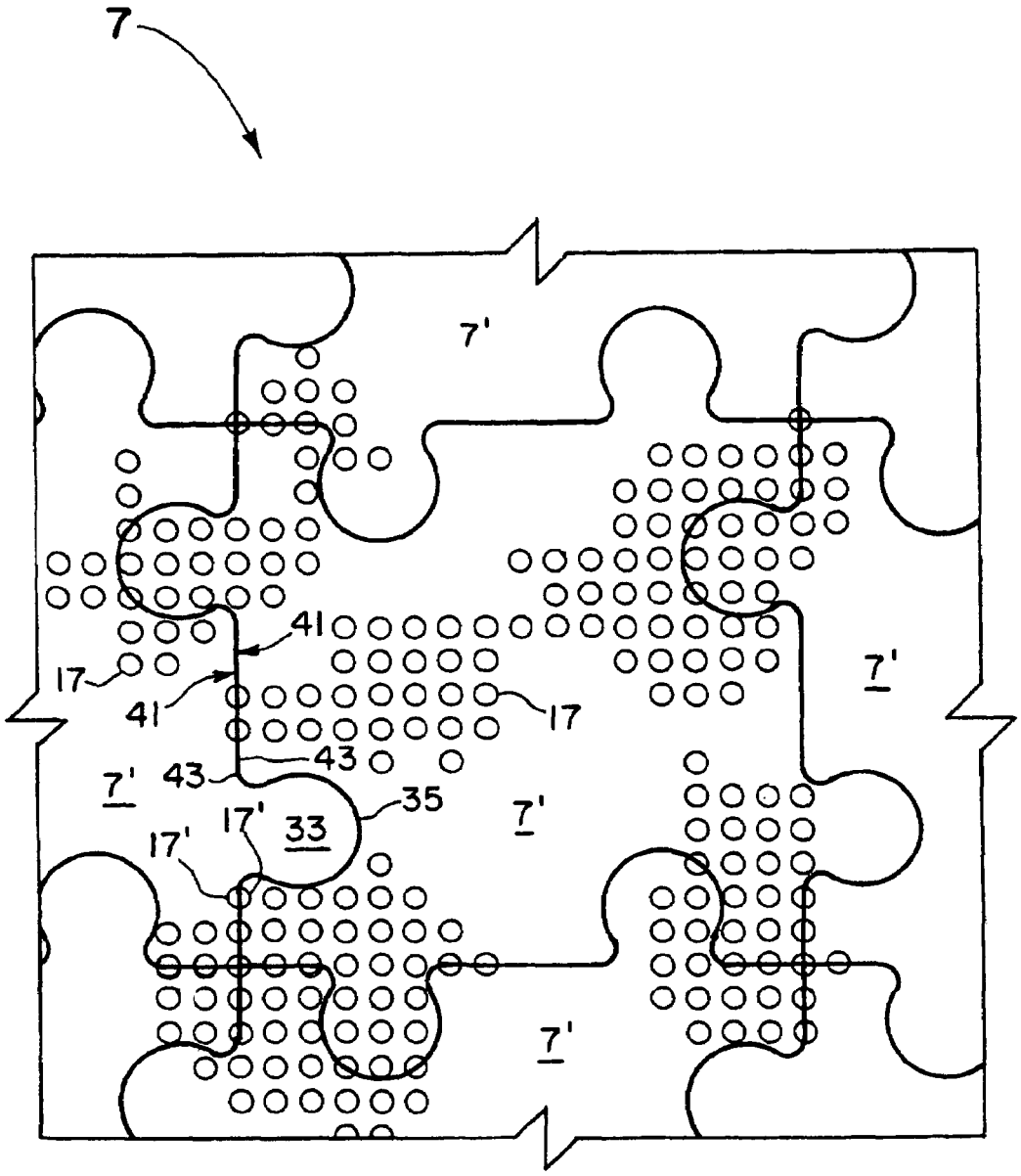
FIG. 8 is a bottom plan view of FIG. 7 also illustrating the interlocked pieces of the modular padding layer as well as the uniform distribution of the feet members both within and between the pieces.
Figure 9:
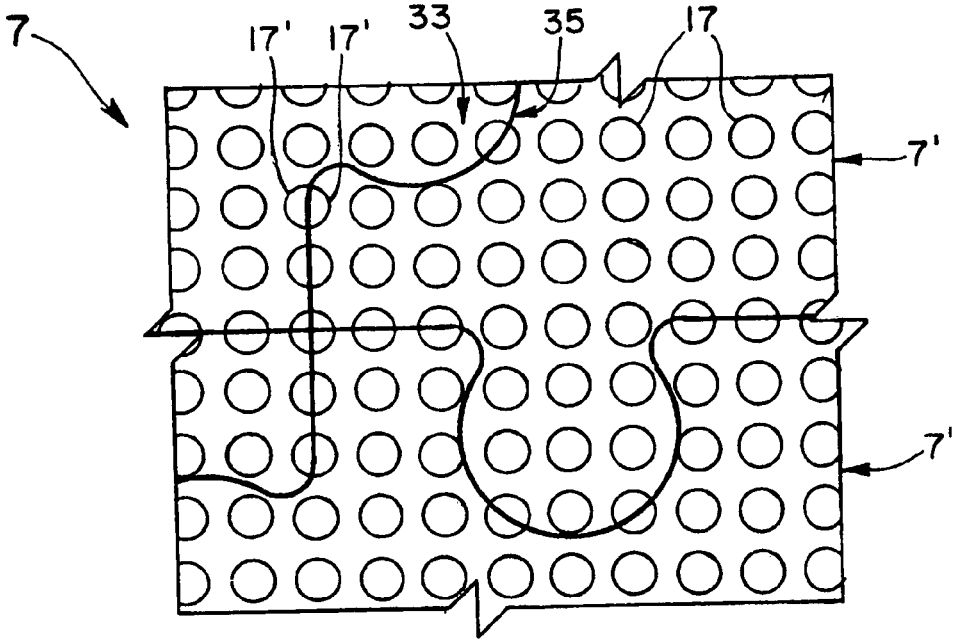
FIG. 9 is an enlarged view of a portion of FIG. 8 further illustrating the uniform distribution of the feet members both within and between the modular pieces of the padding layer.

The padding layer 7 is preferably modular (see FIG. 7 which is a top plan view of an area of the padding layer 7) and includes a plurality of interlocking or releasably attached pieces 7'. In one mode, the pieces 7' are essentially puzzle-type pieces with interlocking and mating male and female portions 33 and 35. The pieces 7' in this regard can be shaped so that halves of each piece 7' (e.g., halves about horizontal axis 37 in FIG. 7) are mirror images of one another that are reversed (i.e., rotated 90 degrees about vertical axis 39 relative to each other). The feet members 17 of the padding layer 7 as discussed above and as illustrated in FIGS. 8 and 9 are substantially uniformly positioned or spaced from one another and are of substantially the same shape (e.g., cylindrical). For clarity, only portions or groups of the complete pattern of the feet members 17 are shown in FIG. 8 but they extend uniformly throughout the padding layer 7 as perhaps best shown in FIG. 9. The pieces 7' are preferably designed and made (e.g., molded) so that the borders or edges 41 of adjacent pieces 7' seamlessly abut one another. More importantly, any feet members 17 that are along or straddle the borders 41 have portions in each adjacent piece 7' (e.g., see portions 17' in FIGS. 8 and 9) that will abut each other. The resulting feet members of the abutting feet portions 17' will then have the same size and shape as the whole feet members 17 in the interior of each modular piece 7'.

This feature is also illustrated in the middle of FIG. 2 wherein the vertical surfaces 43 of the outer and abutting borders 41 of adjacent pieces 7' are shown to divide the common or shared foot member into portions 17'. The abutting foot portions can have the same shape (e.g., equal halves 17' of a cylinder) or can be of different parts of the cylindrical shape. Regardless, the abutting foot portions form a foot member 17 preferably of a uniform shape and size (e.g., cylindrical) with the whole feet members 17 in the interior of the pieces 7'. This is true not only where flat border surfaces abut as in FIG. 2 but also where rounded border surfaces abut as between the rounded and interlocking male and female portions 33 and 35 of FIG. 8. The result is a completely uniform distribution or spacing of the feet members 17 throughout the entire field 1.

Figure 10:
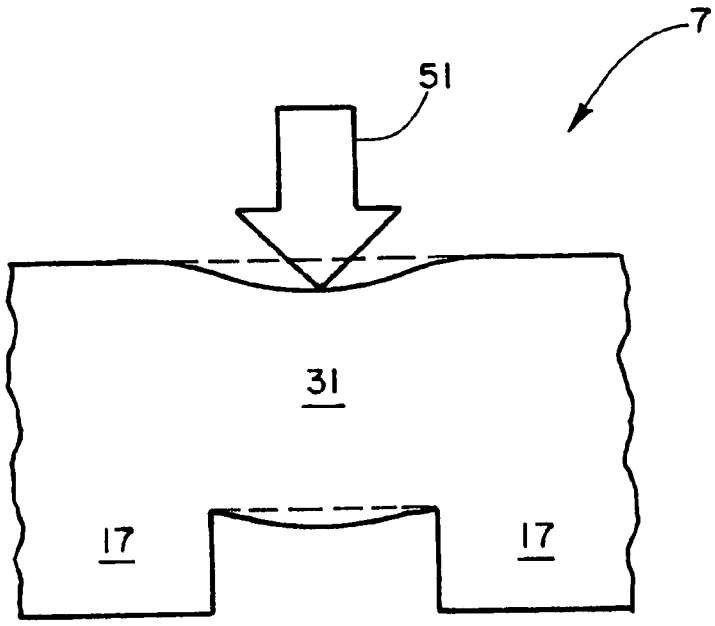
FIG. 10 shows the ability of the main body of the padding layer to deflect between adjacent feet members to aid in absorbing large impacts.
Figure 11:
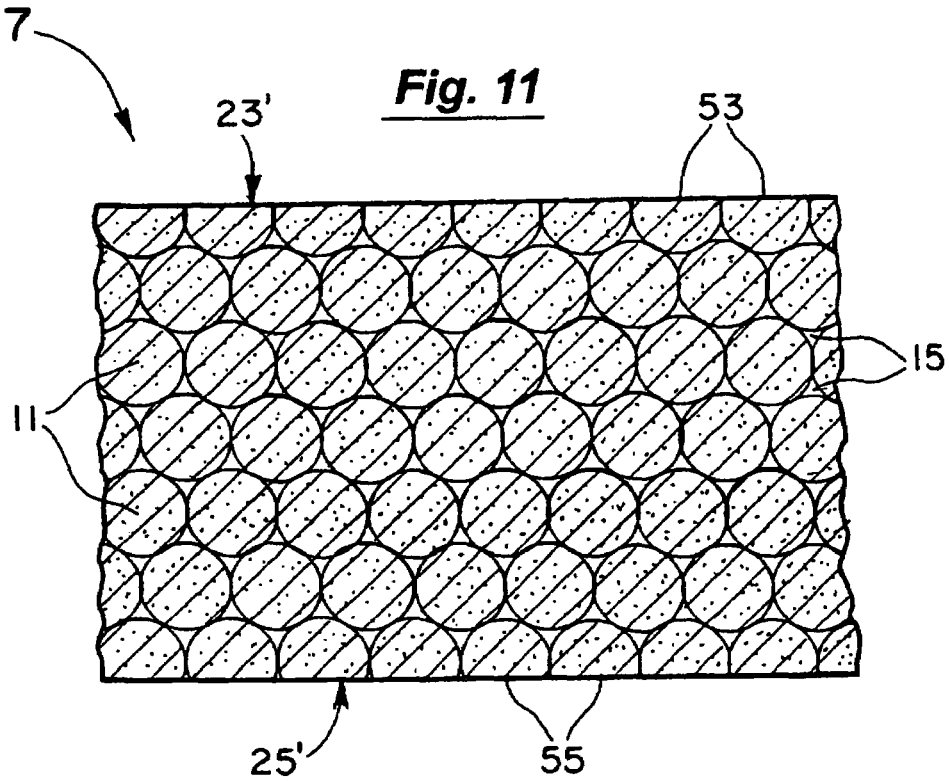
FIG. 11 is an enlarged view of a padding layer according to the present invention that has been cut from a billet rather than molded and has substantially flat, upper and lower surfaces.

The main body 31 of the padding layer as best seen on the left side of FIG. 2 has substantially horizontal, upper and lower surfaces 45 and 47. The feet portions or members 17 then extend substantially vertically downwardly from the lower surface 47 of the main body 31. In this manner, the feet members 17 support the main body 31 of the padding layer 7 from the base or dirt layer 9 creating the laterally extending water channel of portions 25. The feet members 17 are preferably also made of beads 11 and are integrally formed or joined to the main body 31. Consequently, the water at the level of the channel portions 25 also can flow laterally through the feet members 17. In one mode of manufacture, the padding layer 7 including the feet members 17 are molded as one piece. The feet members 17 are illustrated as being substantially cylindrical in shape but could be other shapes (e.g., rectangular, cubic) if desired. In use as illustrated in FIG. 10, the feet members 17 can also aid in allowing the padding layer 7 to absorb major impacts such as 51 (e.g., a football player landing on his helmet). That is and in addition to the elastic, resilient beads 11 absorbing part of the force 51 by compressing and deforming within the main body 31, the main body 31 itself of the padding layer 7 can defect between adjacent feet members 17 as shown in dotted lines in FIG. 10 to further absorb some of the force 51. This can help to reduce the maximum g-forces or impulse forces to the athlete and help to reduce potential injuries.

Figure 12:
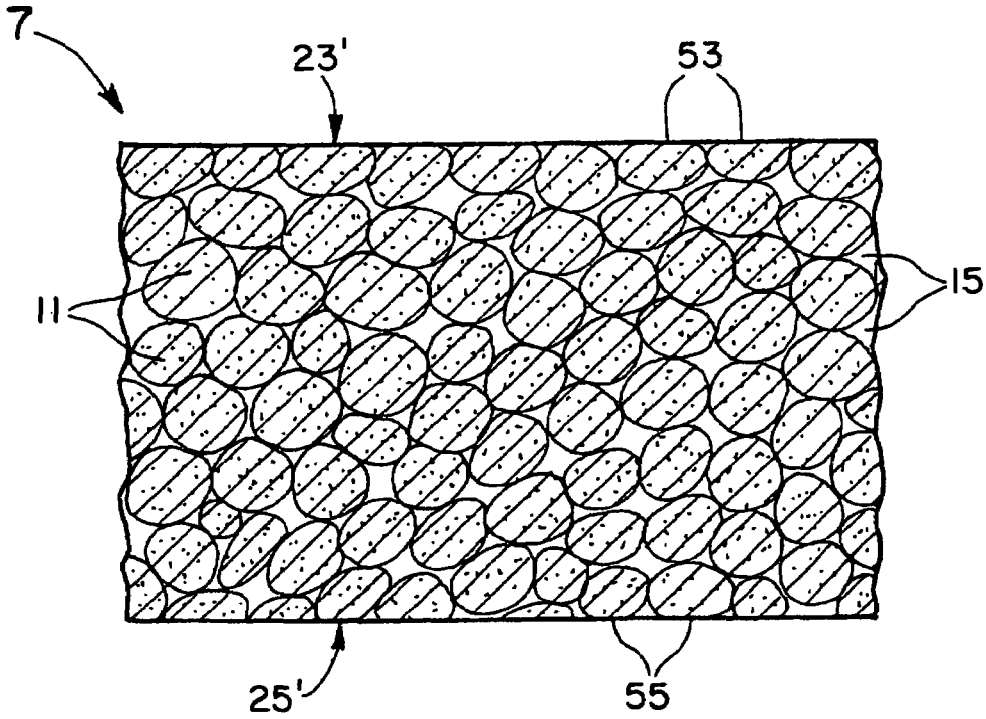
FIG. 12 is a view similar to FIG. 11 illustrating a padding layer made of a mix of rounded beads that are less than perfect spheres.

The shapes of the beads 11 of the padding layer 7 in the embodiments of FIGS. 1-10 and 11 are preferably spherical of the same size (e.g., ⅛ inch diameter). However, the beads can be a mix of diameter sizes (1/12 to ¼ inches or more) as in FIG. 12. Further and although still substantially spherical, the rounded beads 11 of FIG. 12 can have less than perfect spherical shapes. Polyethylene in this regard tends to create more nearly spherical beads as in FIG. 11 while beads of polypropylene as in FIG. 12 tend to be less than ideal spheres. Nevertheless, the spherical description of these beads in this disclosure is intended to cover both examples as well as other rounded beads. Additionally and as discussed above, the padding layer 7 can be molded if desired to create the feet members 17 of FIGS. 1-10. However, the padding layer 7 could be cut from a larger billet of beads creating cut surfaces 53 and 55 (see FIGS. 11 and 12) on the individual, solid beads 11 at the upper and lower surfaces 23' and 25' of the padding layers 7. The individual cut surfaces 53 and 55 of the truncated beads in this regard would be substantially flat and respectively coplanar with one another to substantially align and/or abut with the respective top layer 3 and base or dirt layer 9. Further, the various layers 3, 7, and 9 as well as the film layer 16 can be free floating (i.e., not attached) or attached to one another if desired.

The density of the padding layer 7 (including the foam beads 11 and the bonding agent (e.g., polyurethane) joining the abutting portions of the beads 11) can vary as desired but preferably is in the range of 5-10 pounds per cubic foot and more preferably about 7 pounds per cubic foot. In all cases, the foam is preferably closed cell so as to be waterproof (i.e., non-absorbent). Further, for enhanced performance, padding layer 7 is preferably mostly air. The interstitial air spaces 15 (see FIGS. 11 and 12) between the beads 11 in this regard occupy about 25%-45% and preferably 35%-45% of the total volume of the padding layer 7 with the beads 11 occupying the remainder. The beads themselves can be about 70%-90% air and preferably about 80%-90%. The overall air volume of the padding layer 7 is preferably about 85%-95% air (i.e., interstitial air spaces 15 between the beads 11 of about 35%-45% plus the air in the beads 11 themselves of about 80%-90%). Around these general ranges and depending upon the material makeup of the beads 11, the hardness and resiliency of the field can thus be varied as desired but without detracting from the operation of the padding layer 7 including its ability to absorb and dissipate forces and enhance water drainage management. The thicknesses of the various layers 3 and 7 can also vary as desired with a typical top layer 3 being about one to three inches and the padding layer 7 being 0.5 to 2.5 inches. For identical force absorption, padding layers 7 of polyethylene beads typically are somewhat thicker (e.g., 1.5 to 2.5 inches) than those with beads made of polypropylene which may be more on the order of 0.5 to 1.5 inches thick. In certain sport field applications as for example golf and playgrounds for children, the padding layer 7 can be relatively thin (e.g., 0.5 inches for putting greens) or as thick as desired (e.g., 3 to 6 inches or more for playgrounds). The beads 11 as discussed above are preferably made of elastic, resilient material such as polyethylene or polypropylene but could be made of inelastic, crushable materials such as polystyrene that are essentially incompressible in normal use. The padding layer 7 could additionally be a mix or blend of beads of these materials if desired as well as beads of different diameters and of whole and truncated shapes.

While several embodiments of the present invention have been shown and described in detail, it to be understood that various changes and modifications could be made without departing from the scope of the invention.

We claim:

1. A multi-layered sports playing field for use over a base layer, the playing field including a top layer made of substantially artificial material simulating a natural playing surface and at least one padding layer positionable between the top layer and the base layer, the padding layer being porous and breathable to allow liquids and air to pass through the padding layer, the padding layer including a plurality of discrete beads of substantially elastic, resilient closed cell polypropylene foam material wherein portions of adjacent beads abut one another and other portions of the adjacent beads are spaced from each other to create interstitial spaces between beads, and wherein adjacent beads are integrally joined together to form fused beads that act together to absorb impact forces applied to the padding layer.

2. The playing field of claim 1 in which the beads are joined together in a manner wherein impact forces applied to particular beads or areas of beads under the top layer are dissipated by the interaction of the integrally joined beads.

3. The playing field of claim 1 in which the beads are joined together in a manner wherein, when an impact force is applied to particular beads or areas of beads under the top layer, vertically aligned beads that are directly compressed under the impact force will apply pressure outwardly and compress laterally adjacent beads not directly under the impact force.

4. The playing field of claim 1 in which the beads are joined together in a manner wherein, when an impact force is applied to particular beads or areas of beads under the top layer, vertically aligned beads that are directly compressed under the impact force will draw in adjacent, integrally joined beads toward the vertically aligned beads.

5. The playing field of claim 1 in which the beads are joined together in a manner wherein, when an impact force is applied to particular beads or areas of beads under the top layer, the vertically aligned beads and adjacent beads will not separate, and will not bottom out.

6. The playing field of claim 1 wherein substantially all of the adjacent beads are integrally joined together at the abutting portions thereof.

7. The playing field of claim 1 wherein the plurality of beads form at least two levels of beads wherein beads in the respective levels abut one another and are integrally joined to each other to integrally join the two levels of beads to each other.

8. The playing field of claim 1 wherein the interstitial spaces are substantially uniformly distributed throughout the padding layer.

9. The playing field of claim 1 wherein at least some of the beads of the padding layer form respective upper and lower surfaces of the padding layer wherein the beads of the upper and lower surfaces have substantially flat, coplanar surfaces.

10. The playing field of claim 1 wherein the beads of the padding layer are made of closed cell foam and the total volume of the padding layer including the beads and the interstitial spaces between the other portions of the adjacent beads is about 85% to 95% air.

11. The playing field of claim 1 wherein at least some of the beads of the padding layer form respective upper and lower surfaces of the padding layer wherein the beads of the upper and lower surfaces have substantially flat, coplanar surfaces.

12. A multi-layered sports playing field for use over a base layer, the playing field including a top layer made of substantially artificial material simulating a natural turf surface and at least one padding layer positionable between the top layer and the base layer, the padding layer being porous and breathable to allow liquids and air to pass through the padding layer, the padding layer including a plurality of discrete beads of substantially elastic, resilient closed cell polypropylene foam material wherein portions of adjacent beads abut one another and other portions of the adjacent beads are spaced from each other to create interstitial spaces between beads, and wherein adjacent beads are integrally joined together at the abutting portions to form fused beads that act together to absorb impact forces applied to the padding layer, with the beads being joined together in a manner wherein impact forces applied to particular beads or areas of beads under the top layer are dissipated by the interaction of the integrally joined beads, and with the beads being joined together in a manner wherein, when an impact force is applied to particular beads or areas of beads under the top layer, vertically aligned beads that are directly compressed under the impact force will apply pressure outwardly and compress laterally adjacent beads not directly under the impact force.

13. The playing field of claim 12 in which the beads are joined together in a manner wherein, when an impact force is applied to particular beads or areas of beads under the top layer, the vertically aligned beads and adjacent beads will not separate, and will not bottom out.

14. The playing field of claim 12 wherein the plurality of beads form at least two levels of beads wherein beads in the respective levels abut one another and are integrally joined to each other to integrally join the two levels of beads to each other.

15. A multi-layered sports playing field for use over a base layer, the playing field including a top layer made of substantially artificial material simulating a natural playing surface and at least one padding layer positionable between the top layer and the base layer, the padding layer being porous and breathable to allow liquids and air to pass through the padding layer, the padding layer including a plurality of discrete beads of substantially elastic, resilient closed cell polypropylene foam, wherein portions of adjacent beads abut one another and other portions of the adjacent beads are spaced from each other to create interstitial spaces between beads, and wherein adjacent beads are integrally joined together to form fused beads that act together to absorb impact forces applied to the padding layer, with the beads being joined together in a manner wherein impact forces applied to particular beads or areas of beads under the top layer are dissipated by the interaction of the integrally joined beads, and with the beads being joined together in a manner wherein, when an impact force is applied to particular beads or areas of beads under the top layer, vertically aligned beads that are directly compressed under the impact force will apply pressure outwardly and compress laterally adjacent beads not directly under the impact force, and further with the beads being joined together in a manner wherein, when an impact force is applied to particular beads or areas of beads under the top layer, the vertically aligned beads and adjacent beads will not separate, and will not bottom out.

16. A multi-layered sports playing field for use over a base layer, the playing field including a top layer made of substantially artificial material simulating a natural playing surface and at least one padding layer positionable between the top layer and the base layer and further configured to be modular having a plurality of pieces releasably attached to each other, the padding layer being porous and breathable to allow liquids and air to pass through the padding layer, the padding layer including a plurality of discrete beads of substantially elastic, resilient material wherein portions of adjacent beads abut one another and other portions of the adjacent beads are spaced from each other to create interstitial spaces between beads, and wherein adjacent beads are integrally joined together to form fused beads that act together to absorb impact forces applied to the padding layer.

17. A multi-layered sports playing field for use over a base layer, the playing field including a top layer made of substantially artificial material simulating a natural turf surface and at least one padding layer positionable between the top layer and the base layer and further configured to be modular having a plurality of pieces releasably attached to each other, the padding layer being porous and breathable to allow liquids and air to pass through the padding layer, the padding layer including a plurality of discrete beads of substantially elastic, resilient material wherein portions of adjacent beads abut one another and other portions of the adjacent beads are spaced from each other to create interstitial spaces between beads that are substantially uniformly distributed throughout the padding layer, and wherein adjacent beads are integrally joined together to form fused beads that act together to absorb impact forces applied to the padding layer, with the beads being joined together in a manner wherein impact forces applied to particular beads or areas of beads under the top layer are dissipated by the interaction of the integrally joined beads, and with the beads being joined together in a manner wherein, when an impact force is applied to particular beads or areas of beads under the top layer, vertically aligned beads that are directly compressed under the impact force will apply pressure outwardly and compress laterally adjacent beads not directly under the impact force.

18. A multi-layered sports playing field for use over a base layer, the playing field including a top layer made of substantially artificial material simulating a natural playing surface and at least one padding layer positionable between the top layer and the base layer, the padding layer being porous and breathable to allow liquids and air to pass through the padding layer, the padding layer including a plurality of discrete beads of substantially elastic, resilient closed cell foam material wherein portions of adjacent beads abut one another and other portions of the adjacent beads are spaced from each other to create interstitial spaces between beads, and wherein adjacent beads are integrally joined together to form fused beads that act together to absorb impact forces applied to the padding layer, and where the total volume of the padding layer including the beads and the interstitial spaces between the other portions of the adjacent beads is about 85% to 95% air.

* * * * *